US007060892B2

(12) United States Patent
Whidden

(10) Patent No.: US 7,060,892 B2
(45) **Date of Patent: *Jun. 13, 2006**

(54) METHOD OF TRANSMITTING ELECTRICAL POWER

(76) Inventor: Robert H Whidden, P.O. Box 65, North Lake, WI (US) 53064

( * ) Notice: Subject to any disclaimer, the term of this patent is extended or adjusted under 35 U.S.C. 154(b) by 0 days.

This patent is subject to a terminal disclaimer.

(21) Appl. No.: 11/057,538

(22) Filed: Feb. 14, 2005

(65) Prior Publication Data

US 2005/0139370 A1 Jun. 30, 2005

Related U.S. Application Data

(60) Continuation of application No. 10/379,206, filed on Mar. 4, 2003, now Pat. No. 6,884,935, which is a division of application No. 10/091,929, filed on Mar. 5, 2002, now Pat. No. 6,903,277.

(51) Int. Cl.
*H01B 9/00* (2006.01)

(52) U.S. Cl. ..... 174/34; 174/36

(58) Field of Classification Search ..... 174/32, 174/34, 36, 106 R, 113 R
See application file for complete search history.

(56) References Cited

U.S. PATENT DOCUMENTS

| | | | | |
|---|---|---|---|---|
| 4,446,407 A | | 5/1984 | Sperber | 318/282 |
| 4,668,358 A | | 5/1987 | Ball | 204/150 |
| 4,884,034 A | | 11/1989 | Guzman | 324/529 |
| 5,093,614 A | | 3/1992 | Woodworth | 323/361 |
| 5,157,336 A | | 10/1992 | Crick | 324/613 |
| 5,216,202 A | * | 6/1993 | Yoshida et al. | 174/36 |
| 5,302,905 A | | 4/1994 | Crick | 324/613 |
| 5,365,492 A | | 11/1994 | Dragoset, Jr. | 367/21 |
| 5,479,168 A | | 12/1995 | Johnson et al. | 341/110 |
| 5,638,074 A | | 6/1997 | Johnson | 341/155 |
| 5,640,161 A | | 6/1997 | Johnson et al. | 341/122 |
| 5,793,593 A | * | 8/1998 | Reed et al. | 361/93.4 |
| 5,808,574 A | | 9/1998 | Johnson et al. | 341/110 |
| 5,838,274 A | | 11/1998 | Johnson et al. | 341/155 |
| 5,864,311 A | | 1/1999 | Johnson et al. | 341/155 |
| 5,872,531 A | | 2/1999 | Johnson et al. | 341/110 |
| 5,930,696 A | | 7/1999 | Tzuang et al. | 455/311 |
| 6,114,632 A | | 9/2000 | Planas, Sr. et al. | 174/117 |
| 6,178,129 B1 | | 1/2001 | Chen | 365/206 |
| 6,273,749 B1 | | 8/2001 | Yang | 439/497 |
| 6,884,935 B1 | * | 4/2005 | Whidden | 174/34 |

FOREIGN PATENT DOCUMENTS

| | | |
|---|---|---|
| GB | 2244388 | * 11/1991 |
| JP | 3-119610 | 5/1991 |

* cited by examiner

*Primary Examiner*—Chau N. Nguyen
(74) *Attorney, Agent, or Firm*—Boyle Fredrickson Newholm Stein & Gratz S.C.

(57) ABSTRACT

A method is provided for reducing the stray noise associated with the transmission of the electrical power between a power source and a target. The method includes the step of interconnecting the power source and the target with a conductor. A shield is positioned about the conductor to prevent electromagnetic and radio frequency interference from passing therethrough. A low impedance path is provided for the stray noise to travel between a neutral point of the power source and the isolated target.

15 Claims, 6 Drawing Sheets

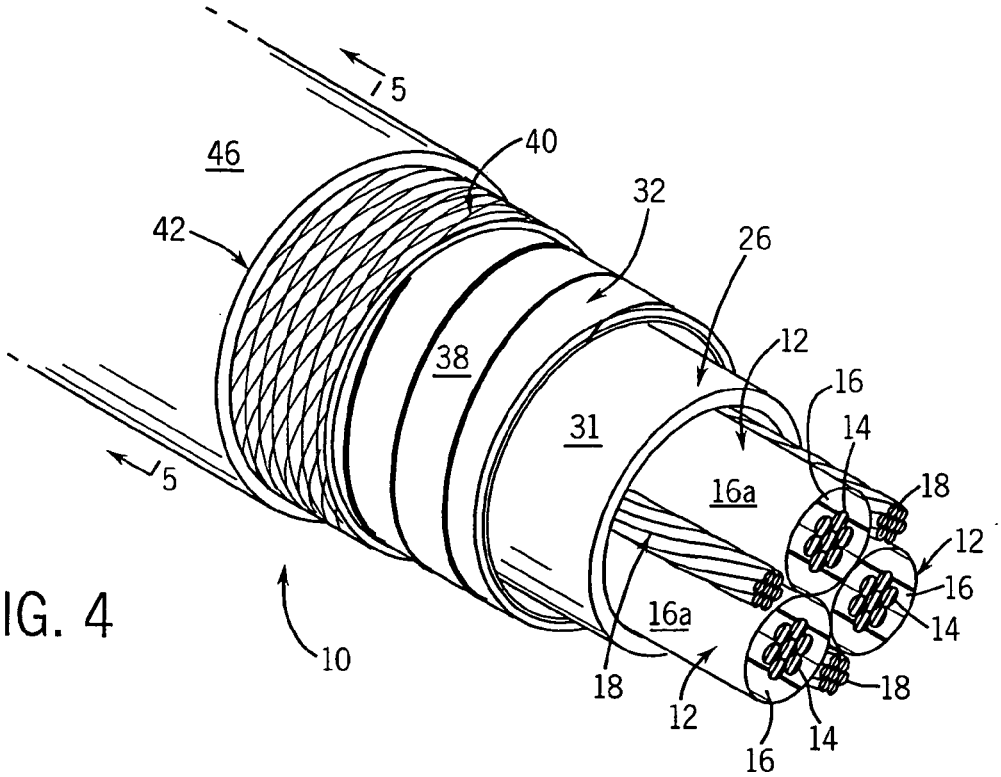
FIG. 4
FIG. 5
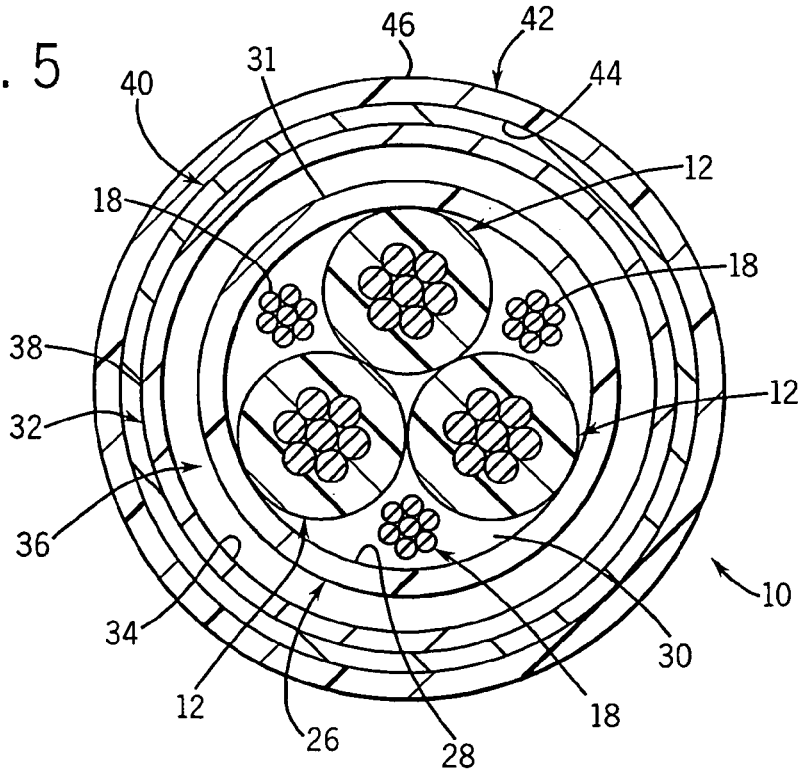

METHOD OF TRANSMITTING ELECTRICAL POWER

CROSS REFERENCE TO RELATED APPLICATION

This application is a continuation application of presently U.S. Application Ser. No. 10/379,206, filed Mar. 4, 2003 now U.S. Pat. No. 6,884,935 and entitled "Method of Transmitting Electrical Power," and which is a division of Ser. No. 10/091,929, filed Mar. 5, 2003 now U.S. Pat. No. 6,903,277 and entitled: "Conduit For Use In The Transmission Of Electrical Power."

RELATED APPLICATION DATA

This application is a division of Ser. No. 10/091,929, filed Mar. 5, 2002, and entitled "Conduit For Use In the Transmission Of Electrical Power."

FIELD OF THE INVENTION

This invention relates generally to the transmission of electrical power, and in particular, to a method for transmitting three-phase electrical power from a power source to a target that significantly minimizes the leakage of common mode noise, the associated phenomenon, and the associated currents created by such transmission that may stray into the physical earth and elsewhere.

BACKGROUND AND SUMMARY OF THE INVENTION

Electrical power is supplied to rural America using three-phase electrical power transmitted over three conductors. In order to minimize the cost of supplying electrical power to these rural areas, the physical earth is used as a return path for the imbalances in electrical power. While functional for its intended purpose, the use of the physical earth as the return path for the three-phase electrical power has resulted in certain unforeseen effects on livestock. More specifically, the energy flowing through physical earth has been found to have a detrimental effect on the feeding habits and milking of livestock, as well as, pregnant livestock and their young.

Compounding the problems associated with the use of physical earth as a return path for the imbalances in electrical power, in order to save costs and conserve energy, farmers have begun utilizing variable frequency drives to power the various motors and equipment utilized on their farms. These variable frequency drives allow a farmer to vary the electrical power supplied to the motors and equipment utilized on the farm, thereby resulting in a significant amount of energy savings for both the farmer and the electrical co-generation facility. However, it has been found that the phase waveforms supplied by the variable frequency drive are not identical at any given time. By transmitting these phase waveforms, common mode noise, and associated phenomenon over the conductors, additional stray currents flow through the physical earth. As heretofore described, these stray currents flowing through the physical earth may cause adverse effects on the livestock maintained on the farm. In view of the foregoing, it can be appreciated that it is highly desirable to minimize the flow of stray currents through the physical earth.

Therefore, it is a primary object and feature of the present invention to provide a method of transmitting three-phase electrical power from a power source to a target.

It is a further object and feature of the present invention to provide a method of transmitting electrical power that minimizes the leakage of common mode noise, associated phenomenon, and stray currents associated therewith.

It is a still further object and feature of the present invention to provide a method of transmitting electrical power that is simple to implement.

It is a still further primary object and feature of the present invention to provide a method of transmitting electrical power that minimizes the effects of such transmission on livestock in close proximity thereto.

In accordance with the present invention, a method is provided to reduce the stray noise associated with the transmission of electrical power between a power source and a target. The method includes the steps of interconnecting the power source and the target with a conductor and positioning a shield about the conductor to prevent electromagnetic and radio frequency interference from passing therethrough. A low impedance path is provided for the stray noise to travel between a neutral point of the power source and the target.

The target is isolated from ground and includes a grounding block that is, in turn, interconnected to the neutral point of the power source with a ground wire. The neutral point of the power source is interconnected to ground. In order to provide a low impedance path, a wire braid is wrapped around the shield. The wire braid has first and second ends. The first end of the wire braid is interconnected to the target and the second end of the wire braid is interconnected to the neutral point of the power source.

In accordance with the further aspect of the present invention, a method is provided to reduce the stray noise associated with the transmission of electrical power between a power source and a target. The method includes the steps of isolating the target from ground and providing a conduit. The conduit includes a conductor, a tubular core, braiding and a flexible outer jacket. The conductor electrically connects the power source and the target. The tubular core extends about the conductor and has the outer surface. The braiding is wound about the outer surface of the core and the flexible outer jacket extends about the braiding. A first end of the conductor is interconnected to the power source and the second end of the conductor is interconnected to the target. The first end of the braiding is interconnected to a neutral point of the power source and a second end of the braiding is interconnected to a grounding block on the target.

The neutral point of the power source is interconnected to ground. In addition, the neutral point of the power source is interconnected to the grounding block of the target with the ground wire. The ground wire may be wrapped around the conductor or positioned adjacent the conductor along the entire length thereof. The braiding may include first and second end portions that extend through the outer jacket of the conduit. The outer jacket also includes first and second ends. Connectors may be mounted on the core adjacent corresponding ends of the outer jacket.

In accordance with a still further aspect of the present invention, a method is provided to reduce the stray noise associated with the transmission of electrical power between a power source and a target. The method includes the step of transmitting electrical power from the power source to the target. A low impedance path to a neutral point of the power source is provided for the stray noise associated with the transmission of the electrical power.

The power source and the target are interconnected with a conductor such that the electrical power is transmitted thereon. A shield may be positioned about the conductor to prevent electromagnetic and radio frequency interference from passing therethrough. In order to provide the low impedance path, wire braiding is wrapped about the shield. The wire braiding has first and second ends. A first end of the wire braiding is interconnected to the target and a second end of the wire braiding is interconnected to the neutral point of the power source.

It is contemplated to isolate the target from ground and to interconnect the neutral point of the power source to ground. The target includes a grounding block that may be interconnected to the neutral point of the power source with a ground wire. The ground wire may be wrapped around the conductor or positioned adjacent thereto.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 4 is an isometric view of a conduit in accordance with the present invention;

FIG. 5 is a cross-sectional view of the conduit of the present invention taken along line 5—5 of FIG. 4;

DETAILED DESCRIPTION OF THE INVENTION

Figure 1:
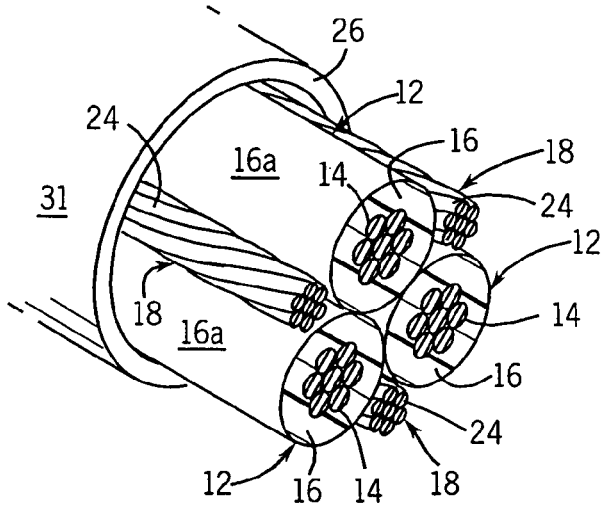
FIG. 1 is an isometric view of a portion of a first configuration of a conduit in accordance with the present invention.

Referring to FIG. 4, a conduit in accordance with the present invention is generally designated by the reference numeral 10. As hereinafter described, it is intended that conduit 10 be used to carry three-phase electrical power from an isolation source transformer 62 to a motor 64, FIG. 9. It can be appreciated that conduit 10 may carry electrical power between other components without deviating from the scope of the present invention, and that the number of phases of electrical power carried by conduit 10 may be varied, by merely varying the number of conductors 12 provided in conduit 10.

Conduit 10 includes a plurality of conductors 12 corresponding in number to the number of phases of the electrical power transmitted thereon. Each conductor 12 includes a plurality of conducting wires 14 positioned adjacent to each other and insulation 16 molded about the grouping of adjacent conducting wires 14. Insulation 16 maintains conducting wires 14 of corresponding conductors 12 adjacent to one another so as to isolate conducting wires 14 of one conductor 12 from the conducting wires 14 of the other conductors 12 in conduit 10.

Figure 2:
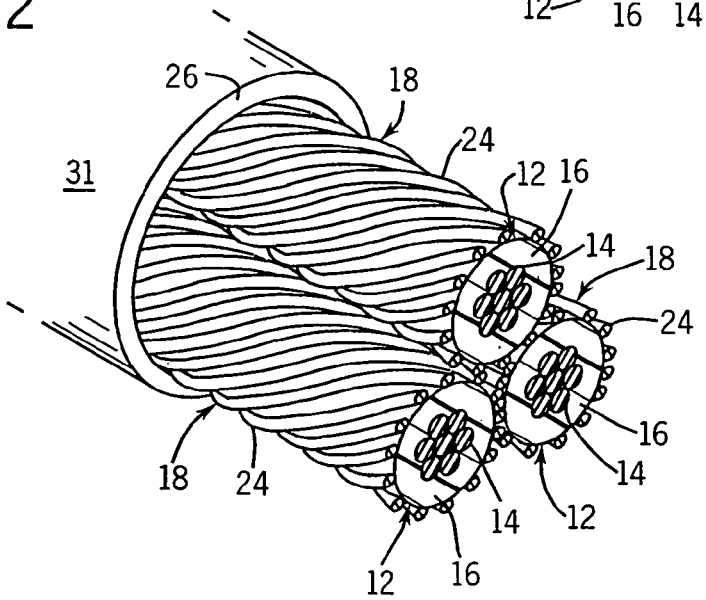
FIG. 2 is an isometric view of a portion of a second configuration of a conduit in accordance with the present invention.
Figure 3:
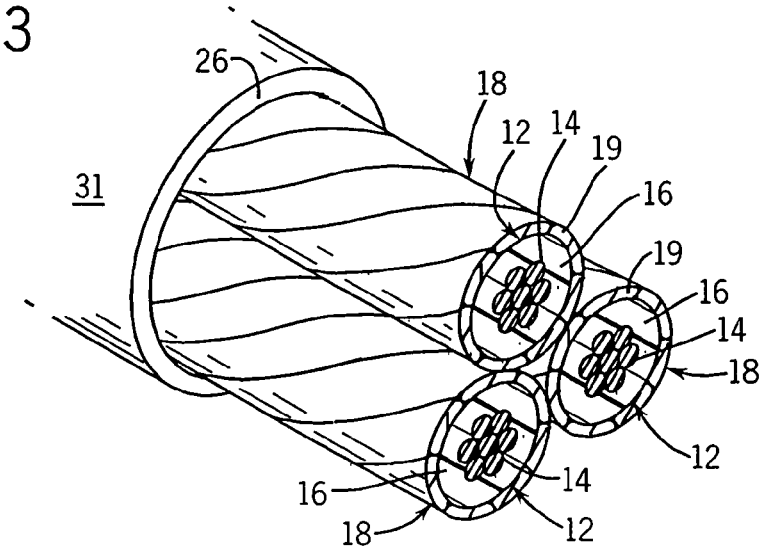
FIG. 3 is an isometric view of a portion of a third configuration of a conduit in accordance with the present invention.

Conduit 10 further includes a plurality of ground wires 18 corresponding to the number of phases of the electrical power transmitted by conduit 10. FIGS. 1–3 disclose alternate configurations of ground wires 18 for use in conduit 10 of the present invention. Referring to FIG. 1, a first configuration of ground wires 18 for conduit 10 is depicted. Each ground wire 18 includes a plurality of ground wire strands 24 grouped together. Ground wires 18 are positioned longitudinally adjacent to outer surfaces 16*a* of insulation 16 of corresponding pairs of conductors 12. Referring to FIG. 2, a second alternate configuration of ground wires 18 for conduit 10 is depicted. The plurality of ground wire strands 24 of ground wire 18 are wrapped about corresponding outer surfaces 16*a* of insulation 16 of conductors 12 in order to maintain wire strands 24 in close proximity to conducting wires 14 of corresponding conductors 12. Referring to FIG. 3, a third alternate configuration of ground wires 18 of conduit 10 is depicted. In the third configuration, ground wire strands 24 of ground wires 18 take the form of metallic tape 19 constructed from heavy copper or the like.

Tape 19 is spirally wrapped about outer surfaces 16*a* of insulation 16 of conductors 12 such that tape 19 is close as possible to conducting wires 14 of corresponding conductors 12.

Inner jacket 26 is provided in order to maintain conductors 16 and corresponding ground wires 18 in close proximity. As best seen in FIG. 5, inner jacket 26 includes an inner surface 28 defining passageway 30 for receiving conductors 12 and ground wires 18 therein, and an outer surface 31. It is contemplated that inner jacket 26 be formed from a flexible material. Conduit 10 further includes a metallic core 32 constructed from galvanized steel, bronze or the like. Core 32 includes an inner surface 34 defining passageway 36 therethrough for receiving inner jacket 26, and an outer surface 38. Wire braid 40 is wrapped about outer surface 38 of core 32. It is intended that wire braid 40 and core 32 shield conductors 12 by preventing electromagnetic interference and radio frequency interference from passing therethrough and that wire braid 40 provide a low impedence path for high frequency associated phenomenon to pass. Conduit 10 further includes an outer jacket 42 wrapped about wire braid 40. Outer jacket 42 includes an inner surface 44 which engages wire braid 40 and an outer surface 46. It is intended for outer jacket 42 to be formed from PVC or a similar material so as to discourage oils, acids, alkalines, ozone and ultraviolet light from passing therethrough.

Figure 6:
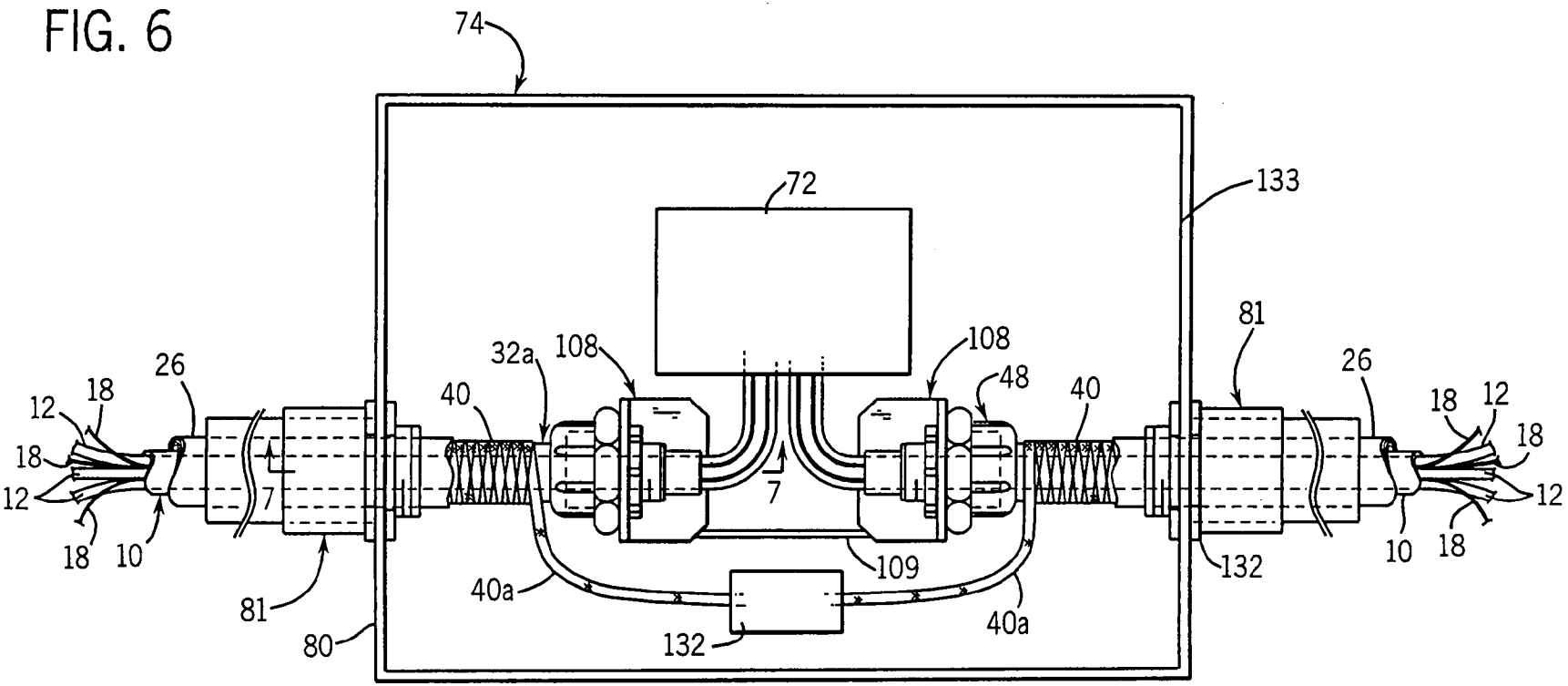
FIG. 6 is a side elevational view, partially in section, showing connection of first and second conduits within a variable frequency drive housing.
Figure 7:
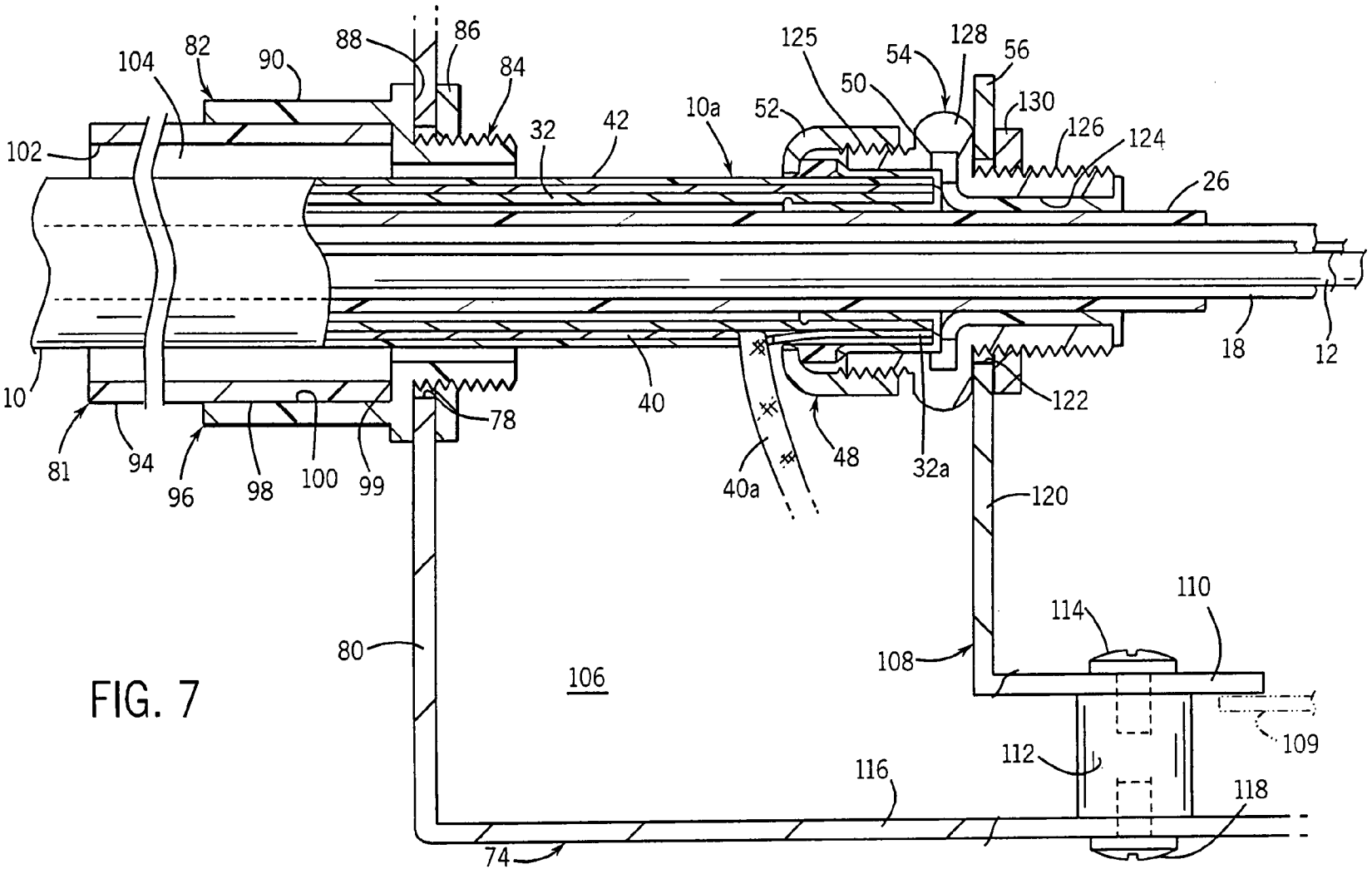
FIG. 7 is an enlarged, cross-sectional view of the housing for the variable frequency drive housing taken along line 7—7 of FIG. 6.

As best seen in FIGS. 6–7, inner jacket 26, conductors 12 and ground wires 18 extend beyond ends 32*a* of core 32. In addition, ends 32*a* of core 32 project through wire braid 40 such that end portions 40*a* of wire braid 40 adjacent corresponding ends 32*a* of core 32 bunch together to facilitate the connection of wire braid 40 to targets such as terminals, wires or the like. End portions 40*a* of metal braid 40 project through outer jacket 42 to further facilitate connection of end portions 40*a* of metal braid 40 to targets. Alternatively, portions of outer jacket 42 adjacent corresponding ends 32*a* of core 32 may be removed to expose end portions 40*a* of metal braiding 40. It can be appreciated that electrical tape or the like may be used to retain the position and configuration of end portions 40*a* of metal braid 40. Connectors 48 are mounted on corresponding ends 32*a* of core 32 to allow conduit 10 to be interconnected to a mounting bracket, junction box or the like. Each connector 48 includes a ferrule 50 threaded onto a corresponding end 32*a* of core 32 and a back nut 52.

Figure 9:
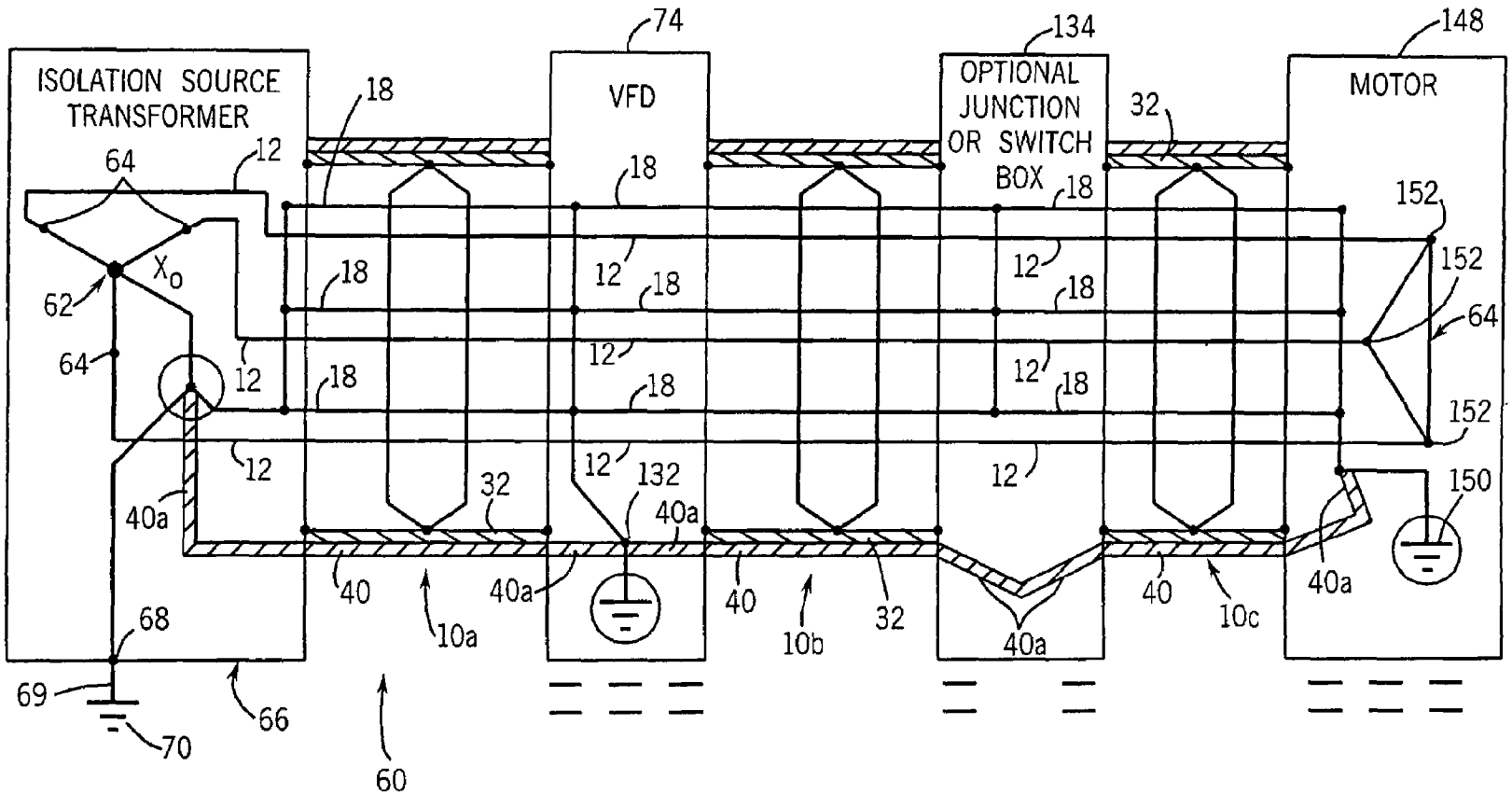
FIG. 9 is a schematic view of an electric circuit utilizing a plurality of conduits in accordance with the present invention.

Referring to FIG. 9, an electrical circuit utilizing first, second and third conduits 10*a*, 10*b* and 10*c*, respectively, is generally designated by the reference numeral 60. First, second and third conduits 10*a*, 10*b* and 10*c* are identical in structure to conduit 10, heretofore described, and as such, the prior description of conduit 10 is understood to describe first, second and third conduits 10*a*, 10*b* and 10*c*, respectively, as if fully described herein with common reference characteristics being used. Conduits 10*a*, 10*b* and 10*c* are used to interconnect isolation source transformer 62, variable frequency drive 72, and motor 64 so as to minimize the leakage of common mode noise, to contain associated phenomenon and to inhibit associated currents that may stray into the physical earth as a consequence of the transmission of electrical power therebetween. As is conventional, isolation source transformer 62 provides three-phase electrical power and includes terminals 64 corresponding to each phase of the electrical power supplied and a neutral point $X_0$. Isolation source transformer 62 is housed in a housing 66 that includes a grounding bus 68 operatively connected to the physical earth 70 by line 69. The first ends of conducting wires 14 of each conductor 12 are operatively connected to corresponding terminals 64 of isolation source transformer 62. The first ends of ground wires 18 are joined together and operatively connected to end portion 40*a* on a first end of wire braid 40; to neutral point $X_0$ of isolation source transformer 62; and to grounding bus 68 of housing 66. A first end 32*a* of core 32 of conduit 10 is rigidly connected to housing 66 utilizing connector 48, as heretofore described.

The second, opposite end of first conduit 10*a* is operatively connected to variable frequency drive 72. As is conventional, variable frequency drive 72 converts three-phase, 60 hertz input electrical power to an adjustable frequency and voltage source for controlling the speed of motor 64. Referring to FIGS. 6 and 7, variable frequency drive 72 is contained within a housing 74 that is isolated from the physical earth. Housing 74 takes the form of an enclosure having an opening 78 in first sidewall 80 thereof so as to allow the second end of first conduit 10*a* to pass therethrough. Guide 81 is provided in opening 78 in first sidewall 80 of housing 74. Guide 81 includes tubular guide member 82 having a first threaded end 84 extending through opening 78 in sidewall 80 of housing 74. Lock nut 86 is threaded onto threaded end 84 of guide member 82 so as to capture sidewall 80 of housing 74 between shoulder 88 formed in outer surface 90 of guide member 82 and lock nut 86. Guide 81 further includes a tubular extension 94 inserted into second end 96 of guide member 82. Extension 94 has an outer surface 98 that abuts shoulder 99 formed in inner surface 100 of guide member 82, and an inner surface 102 which defines a passageway 104 for allowing first conduit 10*a* to pass therethrough. As described, the second end of first conduit 10*a* passes through passageway 102 in extension 94 and through threaded end 84 of guide member 82 into interior 106 of housing 74.

Mounting brackets 108 are provided for supporting the second end of first conduit 10*a* and the first end of second conduit 10*b* within housing 74. Mounting brackets 108 are electrically connected to each other by line 109. Mounting brackets 108 are generally L-shaped and include first legs 110 operatively connected to insulated spacers 112 by bolts 114. Spacers 112 are interconnected to sidewall 116 of housing 74 by bolts 118. As described, spacers 112 electrically isolate mounting brackets 108 from housing 74.

Mounting brackets 108 further include second legs 120 having openings 122 therethrough. Mounting bracket connectors 54 are utilized to interconnect first and second conduits 10*a* and 10*b*, respectively to corresponding mounting brackets 108. Mounting bracket connectors 54 are generally tubular and include inner surfaces 124 defining passageways for allowing inner jacket 26, ground wires 18, and conductors 12 of corresponding conduits 10*a* and 10*b*, respectively, to pass therethrough. Each mounting bracket connector 54 includes threaded first and second ends 125 and 126, respectively, separated by an enlarged diameter portion 128. In order to interconnect mounting bracket connectors 54 to corresponding second legs 120 of mounting brackets 108, second ends 126 of mounting bracket connectors 54 are inserted through corresponding openings 122 in legs 120 of mounting brackets 108. Locking nuts 130 are threaded onto second ends 126 of corresponding mounting bracket connectors 54 so as to capture second legs 120 of mounting brackets 108 between locking nuts 130 and enlarged diameter portions 128 of corresponding mounting bracket connectors 54.

In order to interconnect first conduit 10*a* to a corresponding mounting bracket connector 54, ferrule 50 of connector 48 mounted on second end 32*a* of core 32 of first conduit 10*a* is positioned within first end 125 of mounting bracket connector 54 and back nut 52 of connector 48 is threaded onto first end 125 of mounting bracket connector 54. The second ends of the conducting wires 14 of conductors 12 are operatively connected to corresponding input terminals of variable frequency drive 72. The second ends of ground wires 18 are operatively connected to each other and to grounding bus 132 of housing 74 for variable frequency drive 72. End portion 40*a* on the second end of wire braid 40 of first conduit 10*a* is interconnected to a corresponding end portion 40*a* on a first end of wire braid 40 of a second conduit 10*b* and to grounding bus 132 of housing 74 for variable frequency drive 72.

As hereinafter described, second conduit 10*b* electrically connects the outputs of variable frequency drive 72 to third conduit 10*c* within junction box 134. First ends of conducting wires 14 of conductors 12 of second conduit 10*b* are operatively connected to corresponding outputs of variable frequency drives 72. The first ends of ground wires 18 of second conduit 10*b* are joined together and operatively connected to the second ends of ground wires 18 of first conduit 10*a* and to grounding bus 132 of housing 74. A first end 32*a* of core 32 of second conduit 10*b* is rigidly connected to a corresponding mounting bracket 108 within housing 74 utilizing connector 48, as heretofore described. The first end of second conduit 10*b* passes exit housing 74 through a corresponding guide 81 mounted in opening 132 in second sidewall 133 of housing 74.

Figure 8:
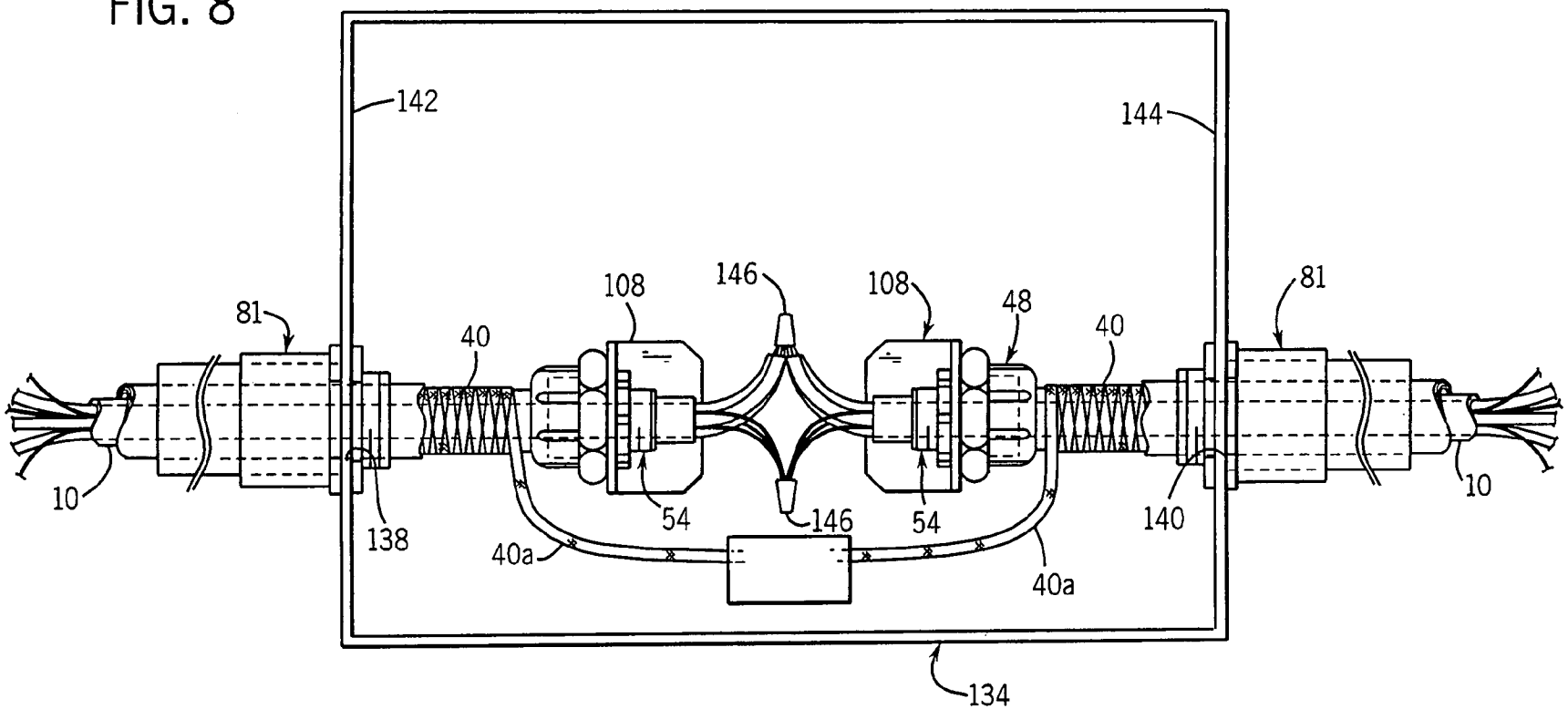
FIG. 8 is a side elevational view, partially in section, showing connection of first and second conduits within a junction box.

As heretofore described, the second, opposite end of second conduit 10*b* is operatively connected to the first end of third conduit 10*c* within junction box 134. Referring to FIGS. 8 and 9, junction box 134 is electrically isolated from the physical earth and takes the form of an enclosure having openings 138 and 140 in corresponding sidewalls 142 and 144, respectively, thereof. Guides 81 are provided in corresponding openings 138 and 140 injunction box 134 so as to allow the second end of the second conduit 10*b*to pass through opening 138 in sidewall 142 and to allow the first end of the third conduit 10*c* to pass through opening 140 in sidewall 144.

Mounting brackets 108 are provided within junction box 134 for supporting corresponding ends of second and third conduits 10*b* and 10*c*, respectively. Mounting bracket connectors 54 are interconnected to second legs 120 of corresponding mounting brackets 108 within junction box 134, as heretofore described. Connector 48 on the second end of the second conduit 10*b* is interconnected to corresponding mounting bracket connector 54 to interconnect second end of the second conduit 10*b* to corresponding mounting bracket 108 within junction box 134 and connector 48 on the first end of third conduit 10*c* is interconnected to a corresponding mounting bracket connector 54 to interconnect first end of third conduit 10*c* to corresponding mounting bracket 108 within the interior of junction box 134.

To electrically connect the second and third conduits 10 within junction box 134, the second ends of conducting wires 14 of conductors 12 of second conduit 10*b* are interconnected to corresponding first ends of conducting wires 14 of conductors 12 of third conduit 10*c* by twist-on wire connector 146 or the like. The second ends of the ground wires 18 of the second conduit 10*b* are operatively connected to each other and to the first ends of the ground wires 18 of third conduit 10*c*. In addition, end portion 40*a* on the second end of wire braid 40 of second conduit 10*b* is interconnected to a corresponding end portion 40*a* on the first end of braid wire 40 of third conduit 10*b*.

As best seen in FIG. 9, motor 64 is supported within housing 148 that is electrically isolated from the physical earth. Housing 148 includes grounding bus 150 operatively connected to end portion 40*a* on the second end of wire braid 40 of third conduit 10*c*. The second ends of ground wires 18 of third conduit 10*c* are joined together and operatively connected to end portion 40*a* on the second end of wire braid 40 of third conduit 10*c* and to grounding bus 150. The second ends of conducting wires 14 of each conductor 12 of third conduit 10 are operatively connected to corresponding terminals 152 of motor 64 so as to provide electrical power to motor 64. Second end 32*a* of core 32 of third conduit 10*c* is originally connected to housing 148 utilizing connector 48, as heretofore described.

In operation, isolation source transformer 62 provides three-phase electrical power at terminals 64 thereof. Conducting wires 14 of conductors 12 of first conduit 10*a* carry the three-phase electrical power to the inputs of variable frequency drive 72. Variable frequency drive 72 generates three-phase electrical power with an adjustable frequency and voltage at the outputs thereof. The outputs of variable frequency drive 72 are electrically coupled to the terminals 152 of motor 64 through conducting wires 14 of conductors 12 of second and third conduits 10*b* and 10*c*, respectively, as heretofore described. Cores 32 and wire braids 40 of first, second and third conduits prevent electromagnetic and radio frequency interference from passing therethrough. In addition, ground wires 18 and cores 32 of conduits 10*a*, 10*b* and 10*c* act as a low impedance conductor to provide a path for the low frequency common mode noise and the associated stray currents generated by the transmission of electrical power on conducting wires 14 of conductors 12 of first, second and third conduits 10*a*, 10*b* and 10*c*, respectively. In addition, wire braid 40 of first, second and third conduits 10*a*, 10*b* and 10*c*, respectively, provides an uninterrupted, very low impedance path for both high frequency electromagnetic and radio frequency noise, and associated waveform phenomenon. As such, the electromagnetic and radio frequency common mode noise, associated waveform phenomenon and associated stray currents are routed with minimized leakage to their point of origin, namely, the neutral point $X_o$ of isolation source transformer 62. It can be appreciated that by isolating housings 66, 72, 74 and 148, as well as, junction box 134 from the physical earth, the common mode noise and currents associated with the transmission of electrical power are unable to stray into the physical earth and elsewhere.

Various modes of carrying out the invention are contemplated as being within the scope of the following claims particularly pointing and distinctly claiming the subject matter which is regarded as the invention.

The invention claimed is:

1. A method to reduce stray noise associated with the transmission of electrical power between a power source and a target, comprising the steps:

interconnecting the power source and the target with a conductor;

positioning a shield about the conductor to prevent electromagnetic and radio frequency interference from passing therethrough; and connecting a neutral point in the power source and the target so as to provide a low impedance path for the stray noise that is free of any electrical components independent of electrical connectors;

wherein the step of connecting the neutral point in the power source and the target includes the steps of:

wrapping wire braiding about the shield, the wire braiding having first and second ends;

interconnecting a first end of the wire braiding to the target; and interconnecting a second end of the wire braiding to the neutral point of the power source.

2. The method of claim 1 comprising the additional step of isolating the target from ground.

3. The method of claim 1 further comprising the additional step of interconnecting the neutral point of the power source to ground.

4. The method of claim 3 wherein the target includes a grounding block and wherein the method includes the additional step of interconnecting the grounding block of the target and the neutral point of the power source with a ground wire.

5. A method to reduce stray noise associated with the transmission of electrical power between a power source and a target, comprising the steps of:

isolating the target from ground;

providing a conduit including:

a conductor for electrically connecting the power source and the target;

a tubular core extending about the conductor and having an outer surface;

braiding wound about the outer surface of the core, the braiding having first and second opposite ends; and a flexible outer jacket extending about the braiding;

interconnecting a first end of the conductor to the power source and a second end of the conductor to the target; and interconnecting the first end of the braiding to a neutral point of the power source and the second end of the braiding to a grounding block on the target so as to provide a low impedance path for the stray noise that is free of energy storing devices.

6. The method of claim 5 further comprising the additional step of interconnecting the neutral point of the power source to ground.

7. The method of claim 5 wherein the method includes the additional step of interconnecting the grounding block of the target and the neutral point of the power source with a ground wire.

8. The method of claim 7 comprising the additional step of wrapping the ground wire around the conductor.

9. The method of claim 7 comprising the additional step of positioning the ground wire adjacent the conductor along the length thereof.

10. The method of claim 5 comprising the additional steps of:

providing the braiding with first and second end portions; and extending the end portions through the outer jacket of the conduit.

11. A method to reduce stray noise associated with the transmission of electrical power between a power source and a target, comprising the steps:

transmitting electrical power from the power source to the target along a conductor, the target including a grounding block; and providing a low impedance path to a neutral point of the power source for the stray noise associated with the transmission of the electrical power that is free of filters;

interconnecting the grounding block of the target and the neutral point of the power source with a ground wire; and positioning the ground wire adjacent the conductor along the length thereof.

12. The method of claim 11 comprising the additional step of:

positioning a shield about the conductor to prevent electromagnetic and radio frequency interference from passing therethrough.

13. The method of claim 11 comprising the additional step of isolating the target from ground.

14. The method of claim 11 further comprising the additional step of interconnecting the neutral point of the power source to ground.

15. A method to reduce stray noise associated with the transmission of electrical power between a power source and a target, comprising the steps:

transmitting electrical power from the power source to the target along a conductor, the target including a grounding block; and providing a low impedance path to a neutral point of the power source for the stray noise associated with the transmission of the electrical power that is free of filter;

interconnecting the grounding block of the target and the neutral point of the power source with a ground wire; and wrapping the ground wire around the conductor.

* * * * *